US008353671B2

(12) United States Patent
Chang et al.

(10) Patent No.: US 8,353,671 B2
(45) Date of Patent: Jan. 15, 2013

(54) FAN WITH PRESSURIZING STRUCTURE

(75) Inventors: Bor-Haw Chang, Sinjhuang (TW); Shu-Fan Liu, Sinjhuang (TW); Chang-Hsien Liu, Sinjhuang (TW)

(73) Assignee: Asia Vital Components Co., Ltd., Sinjhuang, Taipei County (TW)

( * ) Notice: Subject to any disclaimer, the term of this patent is extended or adjusted under 35 U.S.C. 154(b) by 617 days.

(21) Appl. No.: 12/579,412

(22) Filed: Oct. 15, 2009

(65) Prior Publication Data

US 2011/0091315 A1 Apr. 21, 2011

(51) Int. Cl.
*F01D 11/02* (2006.01)

(52) U.S. Cl. ..... 416/174; 415/170.1; 415/171.1; 415/174.5; 415/220; 415/110; 415/229

(58) Field of Classification Search ..... 416/174; 415/170.1, 171.1, 174.5, 220, 110, 111, 121.2, 415/217.1, 229
See application file for complete search history.

(56) References Cited

U.S. PATENT DOCUMENTS

| | | | | |
|---|---|---|---|---|
| 1,831,224 | A * | 11/1931 | Baumann | 277/418 |
| 4,535,373 | A * | 8/1985 | Schuh | 360/97.16 |
| 5,435,574 | A * | 7/1995 | Victor et al. | 277/379 |
| 6,616,422 | B2 * | 9/2003 | Hsieh | 417/354 |
| 6,705,844 | B2 * | 3/2004 | Englander | 417/423.4 |
| 2004/0052662 | A1 * | 3/2004 | Hsiang et al. | 417/423.7 |

* cited by examiner

*Primary Examiner* — Christopher Verdier
*Assistant Examiner* — Andrew C Knopp

(57) ABSTRACT

A fan with pressurizing structure includes a rotor having a main body, blades spaced on the main body, a magnetic body annularly mounted in the main body, and a shaft axially connected to an inner side of the main body; a frame having a sleeve and at least one bearing rotatably received in the sleeve, and an opposing end of the shaft being inserted into the bearing; a stator assembly fitted around the sleeve and including silicon steel plates and a base plate; and a plurality of first pressurizing sections selectively provided on one of the base plate and an end face of the magnetic body. With the first pressurizing sections, deposition of moisture and salt fog in the sleeve and the rotor can be prevented to avoid corroded and damaged bearing and rotor shaft, and the service life of the whole fan is increased.

10 Claims, 10 Drawing Sheets

FAN WITH PRESSURIZING STRUCTURE

FIELD OF THE INVENTION

The present invention relates to a fan with pressurizing structure, and more particularly to a fan with pressurizing structure capable of preventing external moisture and salt fog from entering into and depositing in the fan to corrode and damage internal structure thereof and thereby having increased service life.

BACKGROUND OF THE INVENTION

The currently available cooling fan mainly includes a stator, a rotor, a circuit board, blades, a bearing, and a frame.

With the constantly increased applications of the cooling fan in different fields, from the central processing unit in electronic devices to servers, power supply devices, communication chassis, telecommunication base stations, etc., the cooling fan is frequently used in severe working environment, such as an environment with high humidity and salt fog. Since most of the currently available cooling fans are not provided with any structure for guarding against external moisture and salt fog, the stator and bearing inside the fan are subject to invasion by the moisture and salt fog and easily become corroded. In some worse condition, the circuit board of the fan is also corroded and becomes failed to shorten the fan service life.

To solve the above problems, two solutions have been proposed by those skilled in the art, namely, vacuum coating process and encapsulating process. In vacuum coating process, the stator and the circuit board are entirely coated with a film to obtain a waterproof effect. However, when the fan operates in an environment with salt fog, crystallized salt tends to grow and accumulate in the fan, the vacuum coated film, which is a very thin layer of polymeric compound, is subject to breaking when it is in frictional contact with the crystallized salt in the fan. As a result, electronic components in the fan are invaded by salty water and subject to short circuit and burnout.

In the encapsulating process, the stator and the circuit board are first assembled to the fan frame, and the obtained assembly is positioned in a mold. Then, a predetermined type of encapsulating compound is filled in the mold. After the encapsulating compound is set, the encapsulated assembly is removed from the mold. In this process, the encapsulating compound is filled into all spaces in the stator and the circuit board and encloses the whole stator and circuit board therein, so as to obtain the waterproof effect. A very thick capsule is formed in this process to enclose all the electronic components of the fan therein. Heat produced by the electronic components during operation thereof is not easily dissipated from the thick capsule to thereby cause burnout of the electronic components and failure of the fan.

The vacuum coating process and the encapsulating process are designed mainly for protecting the electronic components of the fan against corrosion by water and salt fog, but fail to prevent external moisture and salt fog from invading into the internal structure of the fan. Therefore, the vacuum coating process and the encapsulating process simply provide a way to protect the circuit board against water, and external water and salt fog can still invade the internal structure of the conventional fans. Moreover, when the fan motor is encapsulated to protect the circuits inside the fan, the heat produced by the motor during operation thereof can not be well dissipated from the capsule, which in turn brings constant rising temperature of the motor. The salt fog invaded into the fan and subjected to the high temperature tends to deposit and crystallize in the fan, and the crystallized salt attaches to the inner walls of the fan, resulting in stuck rotor shaft and bearing and burnt-out circuit board. Therefore, the cooling fan with the conventional ways of guarding against external water and salt fog has the following disadvantages: (1) having shortened service life; (2) having accumulated heat in the fan; and (3) having low heat dissipation efficiency.

It is therefore tried by the inventor to develop an improved fan with pressurizing structure to prevent external moisture and salt fog from entering the fan, so as to overcome the problems existed in the prior art fans.

SUMMARY OF THE INVENTION

A primary object of the present invention is to provide a fan with pressurizing structure, so as to prevent external moisture and salt fog from entering into and depositing in the fan.

To achieve the above and other objects, the fan with pressurizing structure according to a preferred embodiment of the present invention includes a rotor having a main body, a plurality of blades spaced along an outer circumferential surface of the main body, a magnetic body annularly mounted to an inner circumferential surface of the main body, and a shaft having an end axially connected to an inner side of the main body; a frame having a sleeve and at least one bearing rotatably received in the sleeve, and the bearing having an axial bore, into which another opposing end of the shaft is inserted; a stator assembly being externally fitted around the sleeve, and including a plurality of silicon steel plates and at least one base plate; and a plurality of first pressurizing sections being selectively provided on one of a front face of the base plate of the stator assembly and a free end face of the magnetic body. By providing the first pressurizing sections, deposition of moisture and salt fog in the sleeve and the main body of the rotor can be prevented to avoid corrosion and damage of the bearing and the rotor shaft, and accordingly increase the service life of the whole fan and improve the flow fields inside and outside the fan.

The present invention provides the following advantages: (1) increasing the fan service life; (2) preventing external moisture and salt fog from invading and damaging internal structure of the fan; (3) improving the flow fields inside and outside the fan to allow smooth air convection in the fan; and (4) enhancing the heat dissipation efficiency of the fan motor.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
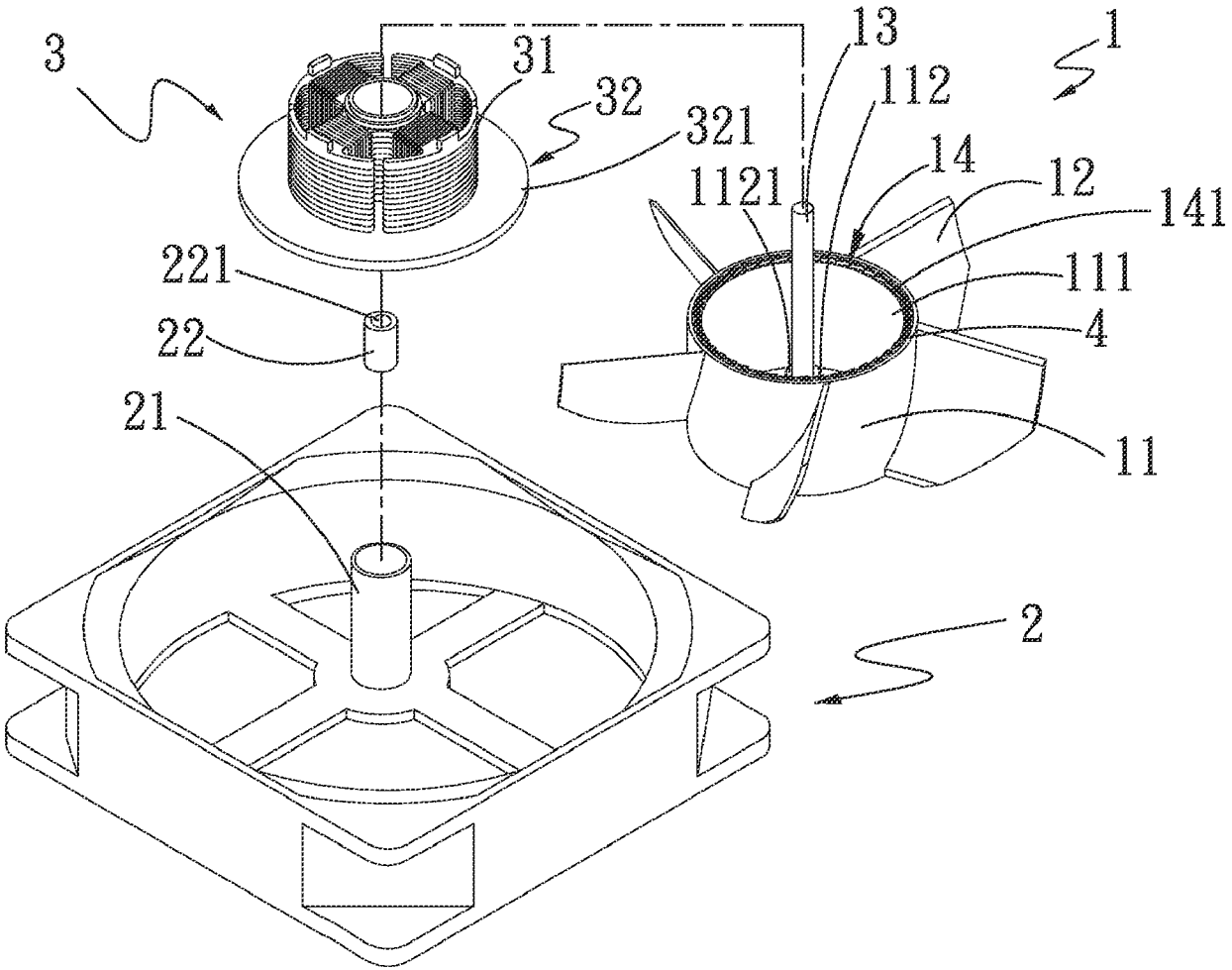
FIG. 1 is an exploded perspective view of a fan with pressurizing structure according to a first embodiment of the present invention.
Figure 2:
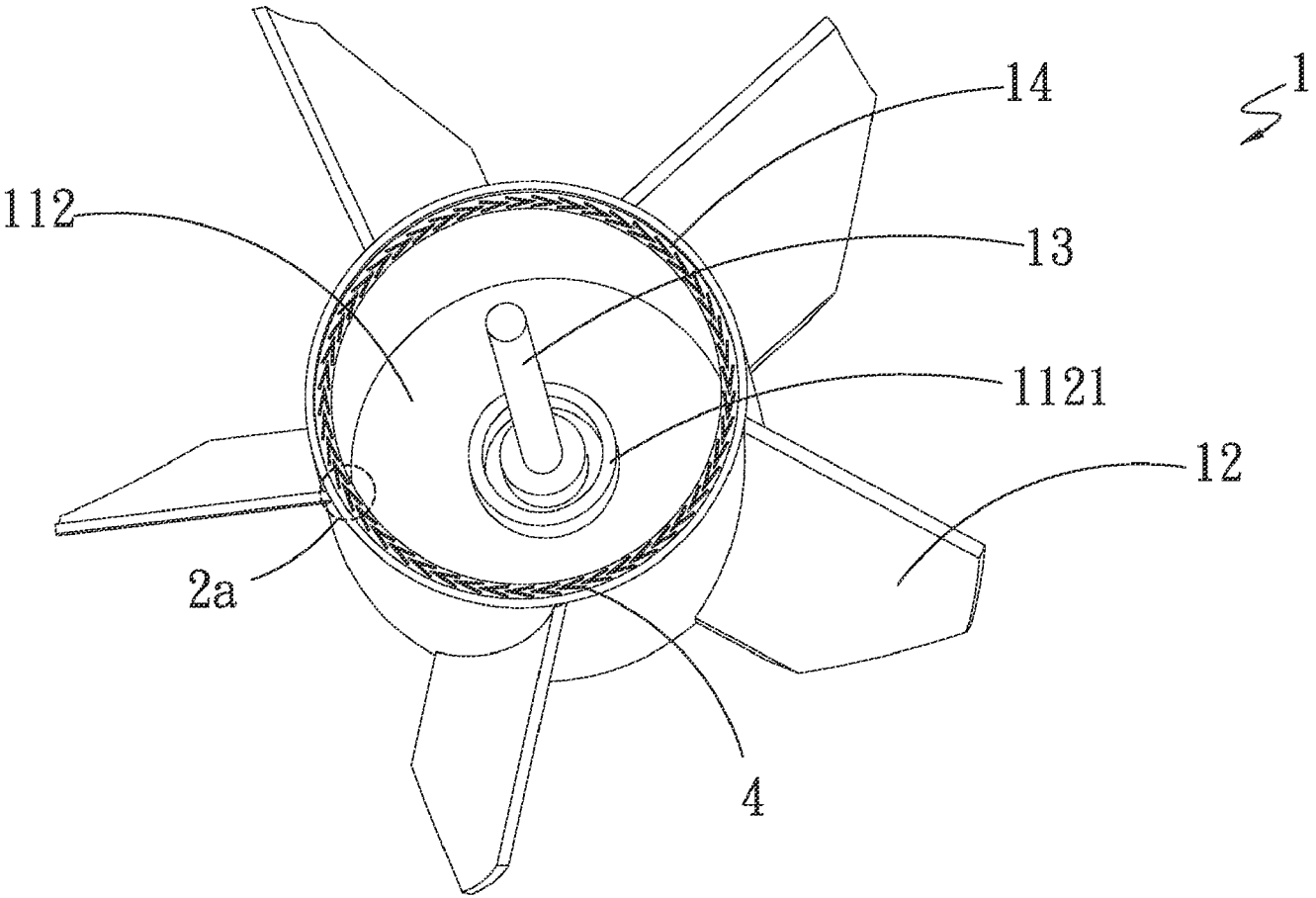
FIG. 2 is a rear perspective view of a rotor for the present invention.
Figure 2A:
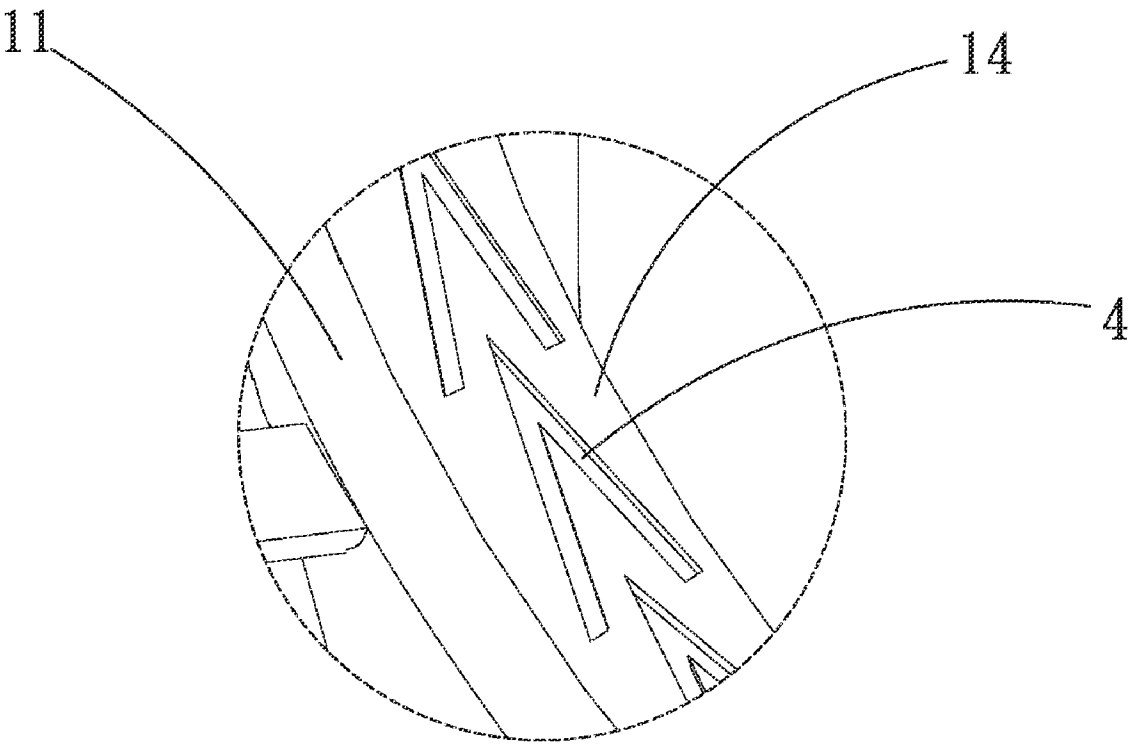
FIG. 2*a* is an enlarged view of the circled area 2*a* of FIG. 2.

Please refer to FIGS. 1, 2 and 2*a*. A fan with pressurizing structure according to a first embodiment of the present invention includes a rotor 1, a frame 2, a stator assembly 3, and a plurality of first pressurizing sections 4.

The rotor 1 includes a main body 11 and a plurality of blades 12. The main body 11 has an open rear end 111 and a closed front end 112. The closed front end 112 is provided on an inner face with a centered shaft mounting portion 1121, and a shaft 13 of the rotor 1 has a proximal end inserted in the shaft mounting portion 1121. The blades 12 are spaced along an outer circumferential surface of the main body 11 to radially outward extend from the main body 11. A magnetic body 14 is annularly mounted on an inner circumferential surface of the main body 11, and has a rear free end face 141.

The frame 2 includes a sleeve 21 and at least one bearing 22 rotatably received in the sleeve 21. The bearing 22 has an axial bore 221, into which a distal end of the shaft 13 is inserted.

The stator assembly 3 includes a plurality of silicon steel plates 31 and at least one base plate 32, and is externally fitted around the sleeve 21 to thereby mount in the frame 2.

With the distal end of the shaft 13 inserted in the axial bore 221 of the bearing 22, the rotor 1 is rotatably mounted in the frame 2 with the magnetic body 14 correspondingly located around the silicon steel plates 31 of the stator assembly 3 and the rear free end face 141 of the magnetic body 14 facing toward a front face 321 of the base plate 32 of the stator assembly 3.

Figure 3:
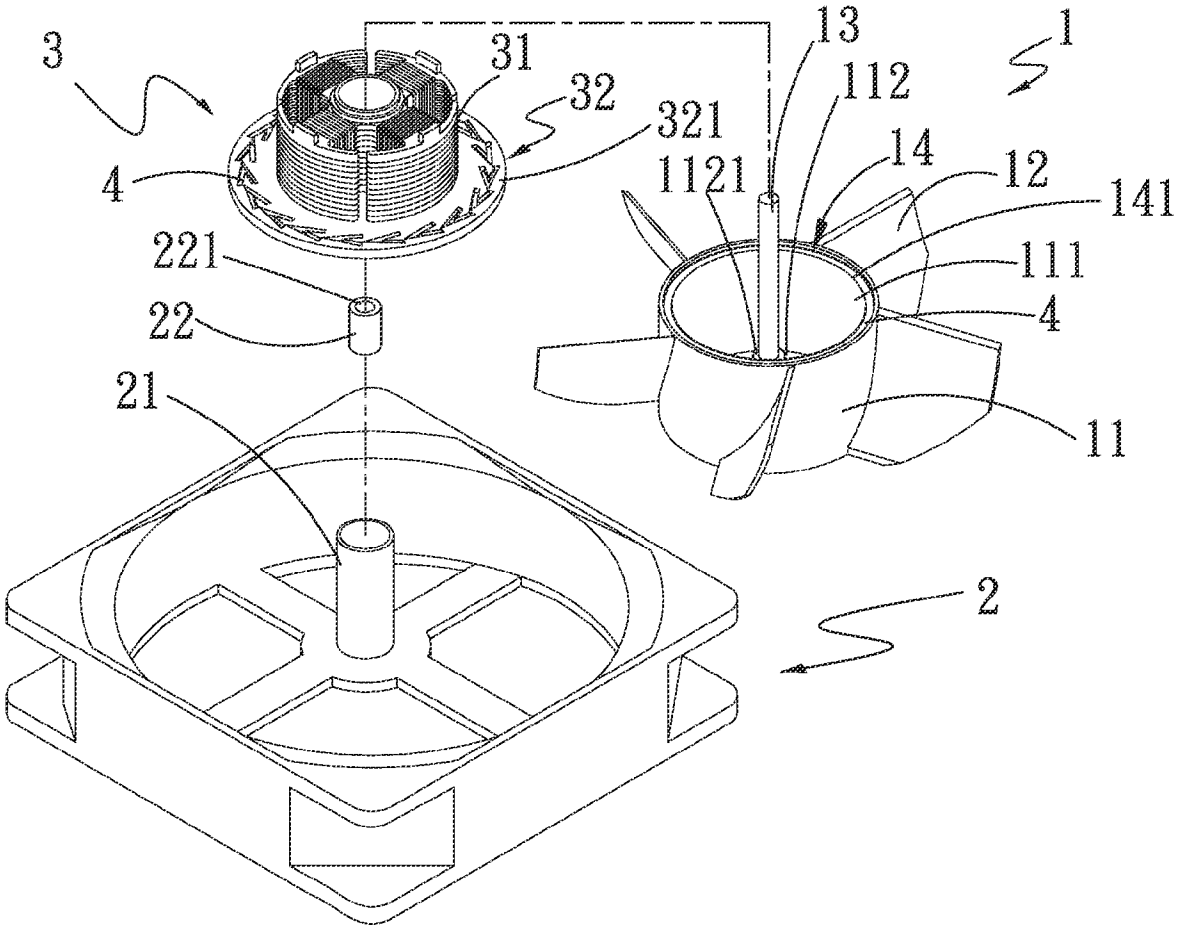
FIG. 3 is an exploded perspective view of a fan with pressurizing structure according to a second embodiment of the present invention.

The first pressurizing sections 4 are provided on the magnetic body 14 to space along the rear free end face 141 thereof. Alternatively, according to a second embodiment of the present invention as shown in FIG. 3, the first pressurizing sections 4 are provided on the front face 321 of the base plate 32 of the stator assembly 3 to space along a peripheral edge of the base plate 32.

Figure 4:
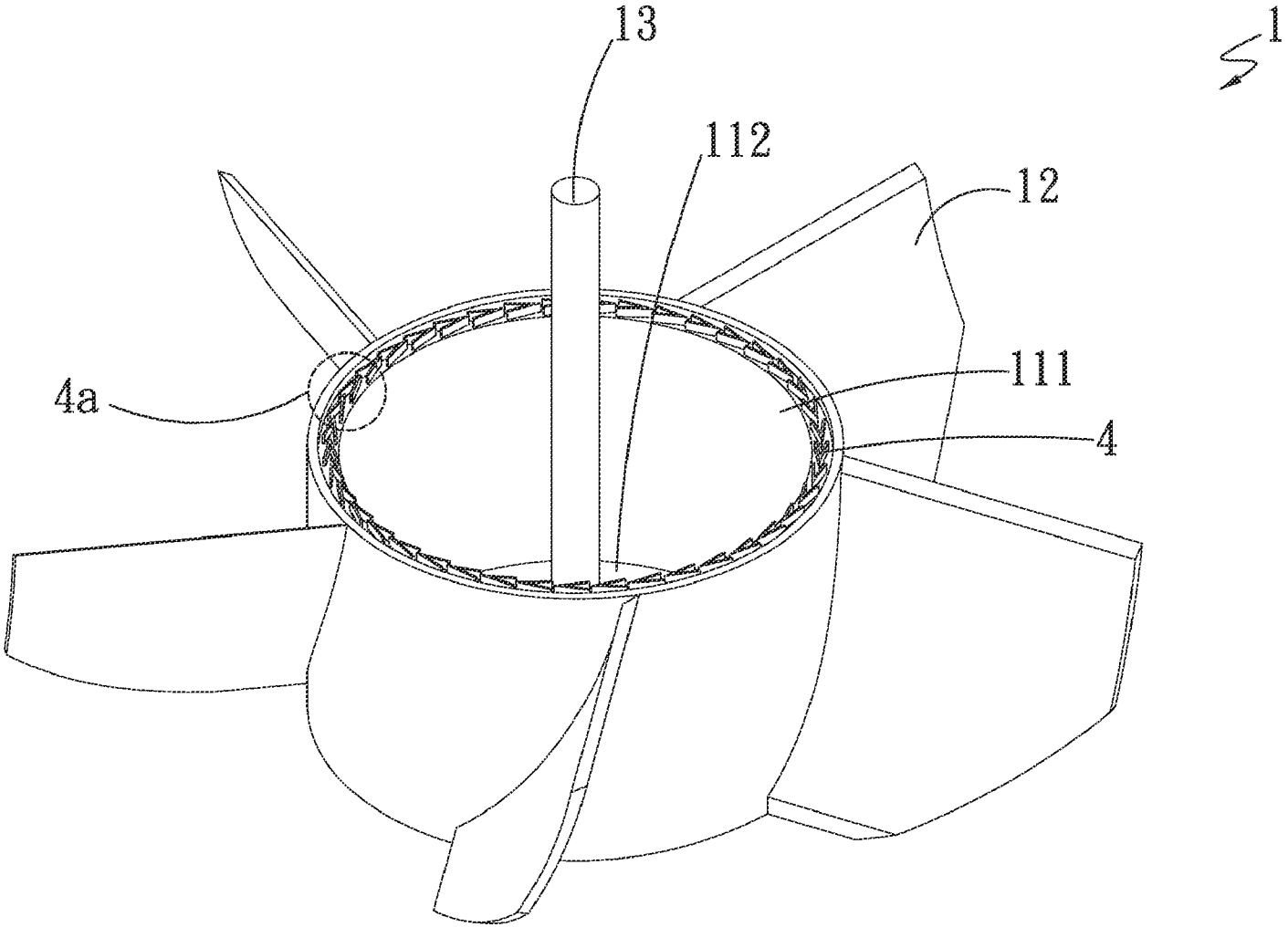
FIG. 4 is another rear perspective view of the rotor for the present invention.
Figure 4A:
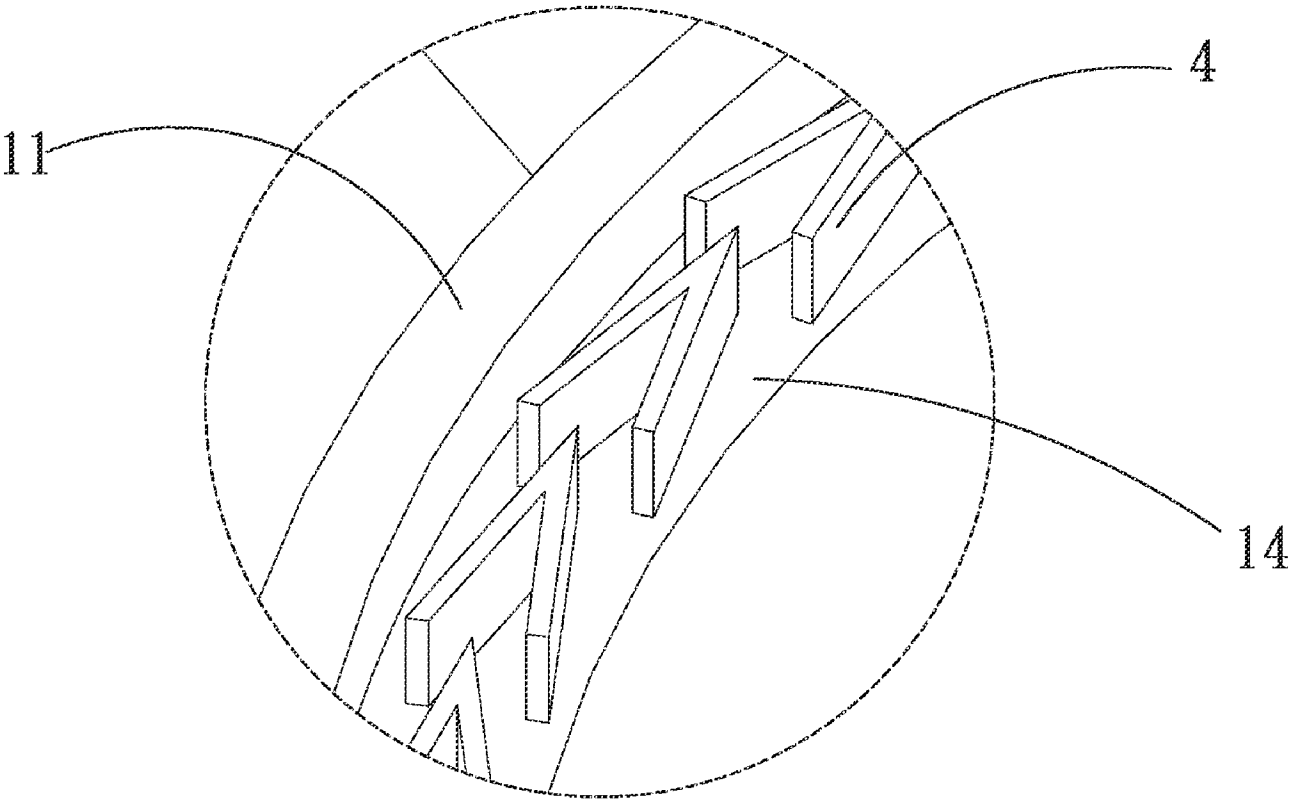
FIG. 4*a* is an enlarged view of the circled area 4*a* of FIG. 4.

The first pressurizing sections 4 according to the present invention can be provided in two different manners. Please refer to FIG. 2*a* that is an enlarged view of the circled area 2*a* of FIG. 2 showing a first manner of providing the first pressurizing sections 4. In this first manner, the first pressurizing sections 4 are sunk into the rear free end face 141 of the magnetic body 14. FIG. 4 is another rear perspective view of the rotor 1 and FIG. 4*a* is an enlarged view of the circled area 4*a* of the FIG. 4. In FIGS. 4 and 4*a*, there is shown a second manner of providing the first pressurizing sections 4. In the second manner, the first pressurizing sections 4 are raised from the rear free end face 141 of the magnetic body 14.

Figure 5B:
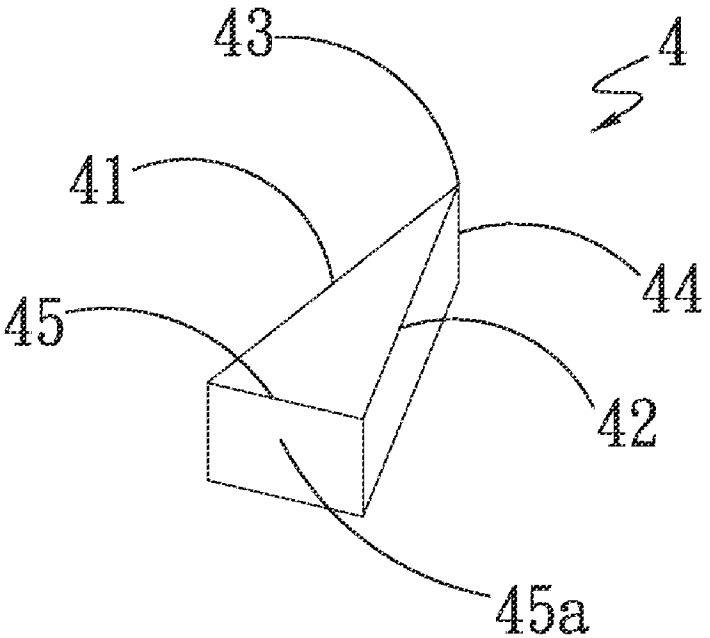
FIG. 5*b* is a perspective view showing a second structural type of the pressurizing section for the present invention.
Figure 5A:
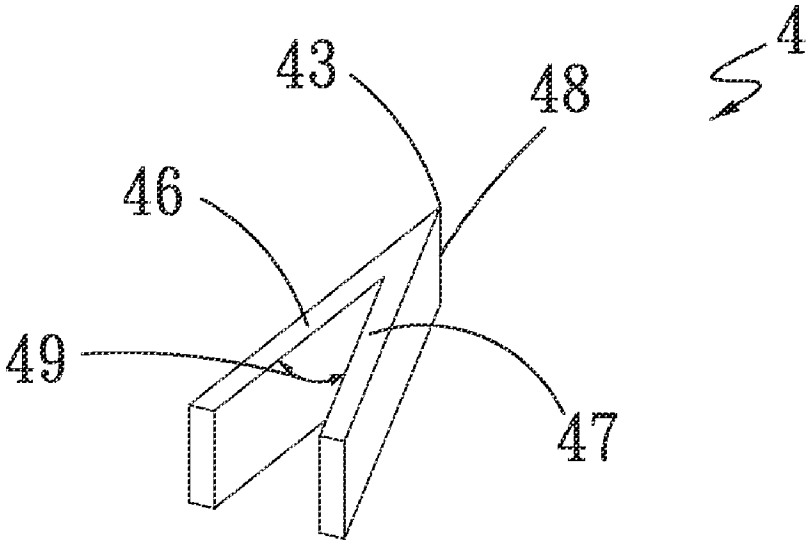
FIG. 5*a* is a perspective view showing a first structural type of a pressurizing section for the present invention.

The first pressurizing sections 4 according to the present invention can be presented in two different structural forms as shown in FIGS. 5*a* and 5*b*. In FIG. 5*b*, the first pressurizing sections 4 each have a first bevel side 41, a second bevel side 42, and a vertex 43. The first and the second bevel side 41, 42 have at least one end converged at the vertex 43 to together define a leading end 44 thereat. The other ends of the first and the second bevel side 41, 42 opposite to the vertex 43 are connected via a third bevel side 45 to together define a tail end 45*a*. In FIG. 5*a*, the first pressurizing sections 4 each have a vertex 43, a first slant rib 46, and a second slant rib 47. The first and the second slant rib 46, 47 have an end converged at the vertex 43 to together define a leading end 48 thereat, and another ends of the first and second slant ribs 46, 47 opposite to the leading end 48 are two free ends spaced from each other, so that the first and the second slant ribs 46, 47 together contain an angle 49 therebetween.

Figure 6:
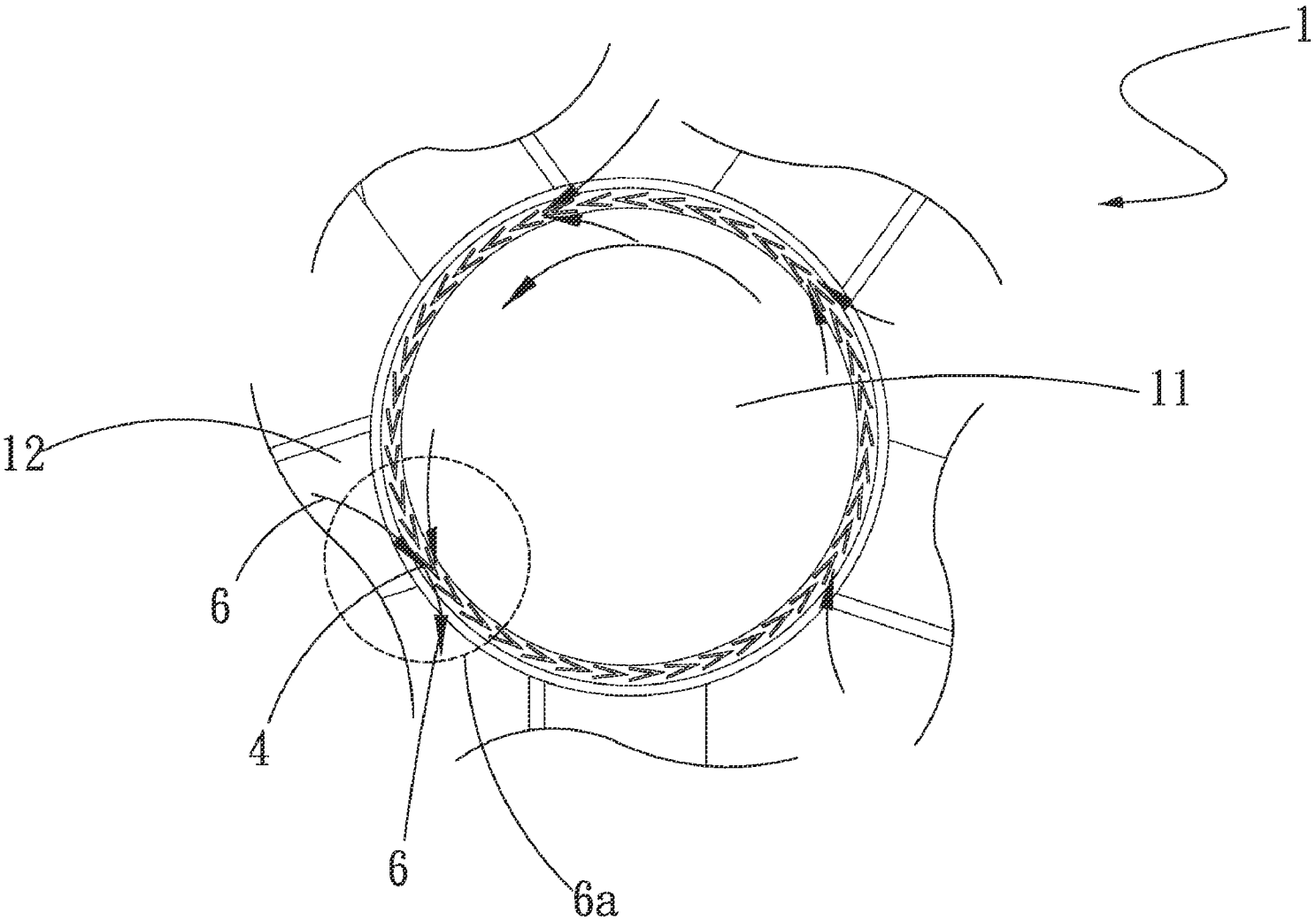
FIG. 6 is a fragmentary, enlarged rear view of the rotor for the present invention.
Figure 6A:
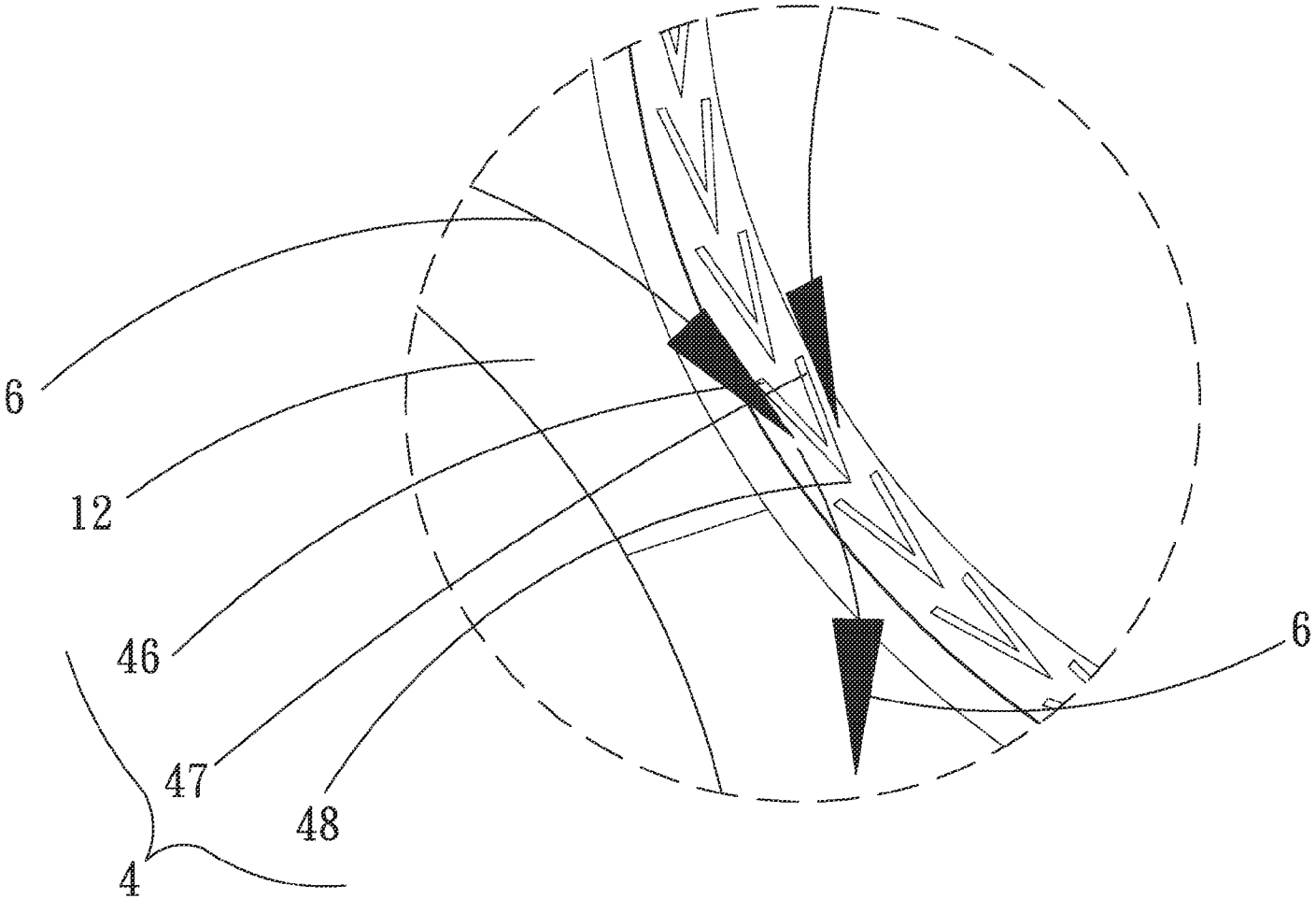
FIG. 6*a* is an enlarged view of the circled area 6*a* of FIG. 6.

FIG. 6 is a fragmentary, enlarged rear view of the rotor for the present invention, and FIG. 6*a* is an enlarged view of the circled area 6*a* of FIG. 6. Please refer to FIGS. 6 and 6*a*. When the fan of the present invention operates, the rotating blades 12 guide an air flow 6 to act on the pressurizing sections 4. The air flow 6 is guided by the blades 12 to flow from a point having a relatively small pressure, that is, the spaced free ends of the first and second slant ribs 46, 47 of the first pressurizing section 4 opposite to the leading end 48, to a point having a relatively large pressure, that is, the leading end 48 of the first pressurizing section 4 that is narrower compared to the other end with the two spaced free ends. As a result, the air flow 6 is increased in its pressure according to the Bernoulli's theorem. The pressure at an inner side and an outer side of the first pressurizing sections 4 is smaller than the air flow 6 flowing through the first pressurizing sections 4. Further, according to the law of conservation of mass, the air flow 6 being affected by the first pressurizing sections 4 will flow into and flow out of the main body 11 of the rotor 1 at an increased rate to thereby enhance the dissipation of heat inside the main body 11 of the rotor 1. Moreover, a swirling effect and a boundary layer effect as a result of a form resistance of the first pressurizing sections 4 can reduce the amount of external moisture and salt fog that enter into the main body 11 of the rotor 1 and accordingly, the production and deposition of crystallized salt in the main body 11.

Figure 7:
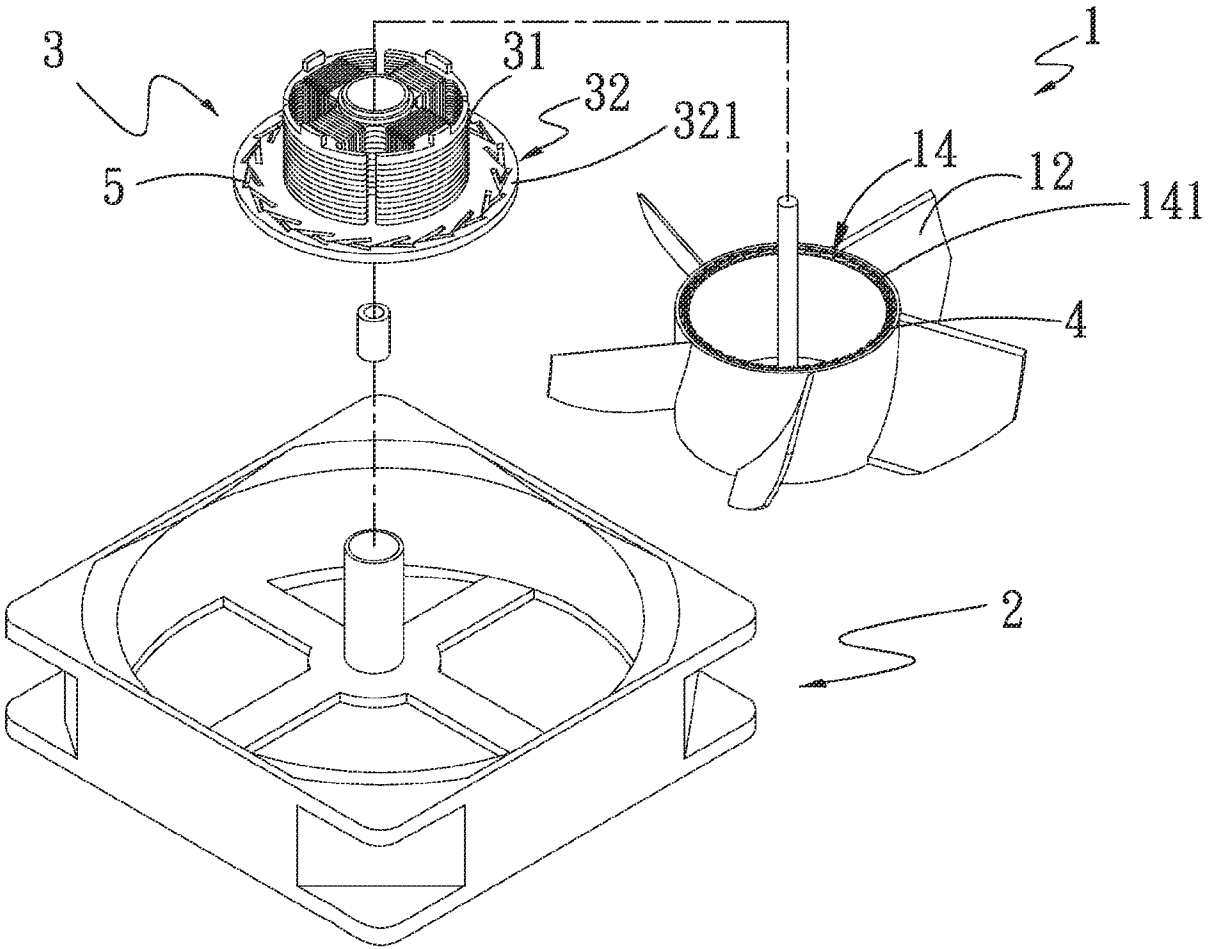
FIG. 7 is an exploded perspective view of a fan with pressurizing structure according to a third embodiment of the present invention.

FIG. 7 is an exploded perspective view of a fan with pressurizing structure according to a third embodiment of the present invention. The third embodiment is generally structurally similar to the previous embodiments, except for a plurality of second pressurizing sections 5. The second pressurizing sections 5 are selectively provided on the rear free end face 141 of the magnetic body 14 or the base plate 32 of the stator assembly 3 at where the first pressurizing sections 4 are not provided. More particularly, when the first pressurizing sections 4 are provided on the rear free end face 141 of the magnetic body 14 as in the first embodiment, the second pressurizing sections 5 are provided on the stator assembly 3 to space along the peripheral edge of the front face 321 of the base plate 32. Alternatively, when the first pressurizing sections 4 are spaced along the peripheral edge of the front face 321 of the base plate 32 of the stator assembly 3 as in the second embodiment, the second pressurizing sections 5 are provided on the rear free end face 141 of the magnetic body 14.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A fan with pressurizing structure, comprising:

a rotor having a main body, a plurality of blades spaced along an outer circumferential surface of the main body, a magnetic body annularly mounted to an inner circumferential surface of the main body, and a shaft having an end axially connected to an inner side of the main body;

a frame having a sleeve and at least one bearing rotatably received in the sleeve, and the bearing having an axial bore, into which an opposing end of the shaft is inserted;

a stator assembly being externally fitted around the sleeve, and including a plurality of silicon steel plates and at least one base plate;

a plurality of first pressurizing sections being selectively provided on one of a face of the base plate of the stator assembly and an end face of the magnetic body~ and wherein the first pressurizing sections each have a first bevel side, a second bevel side, and a vertex; the first and the second bevel side having at least one end converged at the vertex to together define a leading end thereon, and ends of the first and the second bevel side opposite to the vertex being connected via a third bevel side to together define a tail end, wherein the leading ends and tail ends of the first pressurizing sections extend radially from the face on which they are provided.

2. The fan with pressurizing structure as claimed in claim 1, wherein the magnetic body has at least a first end face, and the first pressurizing sections being provided on the first end face of the magnetic body.

3. The fan with pressurizing structure as claimed in claim 1, wherein the main body of the rotor has an open end and a closed end, the closed end is provided on an inner side thereof with a centered shaft mounting portion, to which the shaft of the rotor is connected.

4. The fan with pressurizing structure as claimed in claim 1, wherein the base plate of the stator assembly has at least a second end face, and the first pressurizing sections being provided on the second end face of the base plate.

5. The fan with pressurizing structure as claimed in claim 1, further comprising a plurality of second pressurizing sections being provided on one of the face of the base plate of the stator assembly and the end face of the magnetic body that is not provided with the first pressurizing sections.

6. A fan with pressurizing structure, comprising:

a rotor having a main body, a plurality of blades spaced along an outer circumferential surface of the main body, a magnetic body annularly mounted to an inner circumferential surface of the main body, and a shaft having an end axially connected to an inner side of the main body;

a frame having a sleeve and at least one bearing rotatably received in the sleeve, and the bearing having an axial bore, into which an opposing end of the shaft is inserted;

a stator assembly being externally fitted around the sleeve, and including a plurality of silicon steel plates and at least one base plate;

a plurality of first pressurizing sections being selectively provided on one of a face of the base plate of the stator assembly and an end face of the magnetic body; and wherein the first pressurizing sections each have a vertex, a first slant rib, and a second slant rib; the first and the second slant rib having an end converged at the vertex to together define a leading end thereat, and ends of the first and second slant ribs opposite to the leading end being free ends spaced from each other, so that the first and the second slant ribs together contain an angle therebetween, wherein the leading ends of the first pressurizing sections extend radially from the face on which they are provided.

7. The fan with pressurizing structure as claimed in claim 6, wherein the magnetic body has at least a first end face, and the first pressurizing sections being provided on the first end face of the magnetic body.

8. The fan with pressurizing structure as claimed in claim 6, wherein the main body of the rotor has an open end and a closed end, the closed end is provided on an inner side thereof with a centered shaft mounting portion, to which the shaft of the rotor is connected.

9. The fan with pressurizing structure as claimed in claim 6, wherein the base plate of the stator assembly has at least a second end face, and the first pressurizing sections being provided on the second end face of the base plate.

10. The fan with pressurizing structure as claimed in claim 6, further comprising a plurality of second pressurizing sections being provided on one of the face of the base plate of the stator assembly and the end face of the magnetic body that is not provided with the first pressurizing sections.

* * * * *